United States Patent [19]

Geffriaud et al.

[11] Patent Number: 4,948,301

[45] Date of Patent: Aug. 14, 1990

[54] DEVICE COMPRISING A VALVE FOR INJECTING GROUT AROUND OR INSIDE A TUBULAR PILE DRIVEN INTO THE GROUND

[75] Inventors: Jean-Paul Geffriaud, Paris; Herve Barthelemy, Croissy-Sur-Seine, both of France

[73] Assignee: Soletanche, Nanterre, France

[21] Appl. No.: 313,205

[22] Filed: Feb. 21, 1989

Related U.S. Application Data

[63] Continuation-in-part of Ser. No. 72,535, Jul. 13, 1987, abandoned, which is a continuation-in-part of Ser. No. 770,721, Aug. 29, 1985, abandoned.

[30] Foreign Application Priority Data

Aug. 31, 1985 [FR] France ..... 84 13500

[51] Int. Cl.[5] ..... F02D 5/54

[52] U.S. Cl. ..... 405/244; 405/232; 405/236; 405/248

[58] Field of Search ..... 405/225, 232, 233, 236–243, 405/244, 248; 166/185, 186, 187, 289; 137/512, 853

[56] References Cited

U.S. PATENT DOCUMENTS

| | | | |
|---|---|---|---|
| 2,344,120 | 3/1944 | Baker | 166/289 |
| 2,906,345 | 9/1959 | Tausch et al. | 166/185 |
| 3,358,770 | 12/1967 | Zandmer | 166/289 X |
| 4,412,759 | 11/1983 | Britton et al. | 405/225 |
| 4,589,484 | 5/1986 | Doherty et al. | 166/187 X |

FOREIGN PATENT DOCUMENTS

| | | | |
|---|---|---|---|
| 2323822 | 4/1977 | France | 405/225 |
| 38065 | 5/1936 | Netherlands | 166/185 |

*Primary Examiner*—Dennis L. Taylor

*Attorney, Agent, or Firm*—Guy W. Shoup; Paul J. Winters

[57] ABSTRACT

A device for injecting grout around a tubular pile driven into the ground. The tubular pile has a given diameter and is formed by a tubular wall of a given wall thickness defining the inside and outside of the tubular pile. A grout feed channel capable of being driven into the ground with the tubular pile is disposed inside the tubular wall having a diameter which is small relative to the diameter of the tubular pile. A check valve is connected to the grout feed channel at a position along the tubular wall and extends through the thickness of the tubular wall so as to communicate from the grout feed channel through the outside of the tubular wall. An injection device is inserted in the grout feed channel having one plug which is fitted in the grout feed channel and located above the check valve so as to inject grout under pressure through the injection device and the check valve to the outside of the tubular wall.

17 Claims, 4 Drawing Sheets

Figure 1:
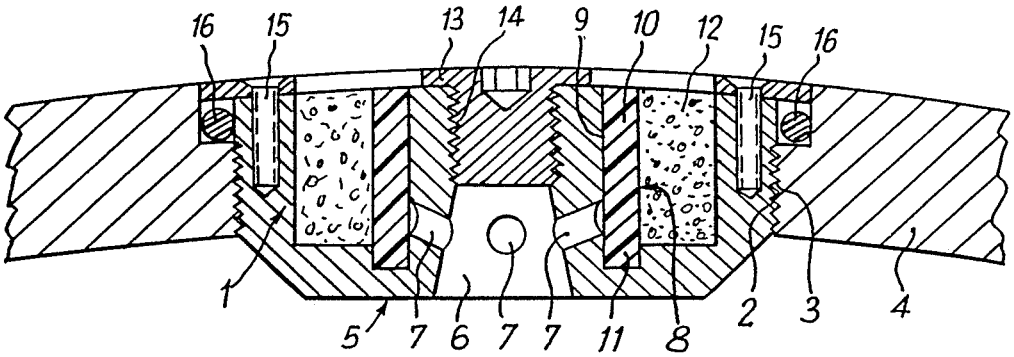

DEVICE COMPRISING A VALVE FOR INJECTING GROUT AROUND OR INSIDE A TUBULAR PILE DRIVEN INTO THE GROUND

This application is a continuation-in-part of application Ser. No. 072,535, filed July 13, 1987, now abandoned which is a continuation-in-part of application 770,721 filed Aug. 29, 1985, now abandoned.

The present invention concerns a new device that allows the injection of grout in the ground surrounding hollow tubular piles driven into the ground or in the ground located inside the sames.

Injection grout is a liquid composition generally based on cement that is injected under pressure into the ground, where it finally hardens. Piles consisting of steel tubes driven into the ground are employed in particular in recovering petroleum or natural gas, especially at sea. Such piles are in particular driven into the ground to counteract the forces, especially vertical forces, accomodated by the foundations of various types of device such as the structures employed in obtaining petroleum.

It is as is known sometimes necessary to extend the piles in order to position secondary, telescopic piles with a shorter diameter that slide through the primary pile, an operation that presupposes and implies that the inside of the primary tube is clean and smooth, so that the outside diameter of the secondary pile can be as long as possible.

In a certain number of cases it is as is known also necessary subsequent to driving in the piles to inject grout around them (between, that is, the tubes that constitute the pile in the strict sense of the word and the ground that it has been driven into) with the object of immobilizing the pile in relation to the ground or at least of highly increasing the friction between the pile and the ground.

It is known, finally, that several such injections are often necessary to attain successful results, meaning that the equipment involved must serve over and over.

Injecting a cement-based grout of this type around piles or inside piles driven into the ground accordingly involves significant problems and is even sometimes impossible.

The present invention concerns a device positioned stationary in the wall of the tube constituting the pile and, upon being positioned preferably before the pile has been driven in, will simply and economically allow one or more injections as necessary without preventing the ascent of the earth within the tube while the latter is being driven in, without necessitating preliminary excavation of the ground, or impeding the later positioning of a shorter-diameter, telescopic secondary pile.

An object of the invention is a device for injecting grout into the soil in the outside or in the inside of a tubular pile driven into the soil comprising a grout-feed channel with a relatively small diameter compared to the diameter of the pile positioned on the inside surface of the wall of the tube that constitutes the pile, said grout-feed channel being connected to at least one check-valve, which makes it possible to position at the level of any check-valve an injection device including an injection line with preferably two plugs located one above and one under the check-valve and to introduce grout arriving under pressure from the injection line through the check-valve, on the outer or in the inner side of the pile wall.

According to the invention in said device the check-valves are located along one generatrix in the wall of the pile.

It is also possible to employ an injection line with only one plug if the grout sets at a prescribed rate. In this case, the plug is positioned above the check-valve to be injected through, the end of the injection line abouting under the plug in the vicinity of the check-valve, the injections being successively carried out from the bottom check-valve to the top check-valve.

In one embodiment of the invention the grout-feed channel is a U-shaped section of steel extending along a generatrix of the inside surface of the wall of the pile and in front of the check-valves with its longitudinal edges welded to the inside surface of the wall. Shaped pieces are located inside the U-section channel in the vicinity of each check-valve to provide those sites with a circular cross-section that allows the plugs to form a tight seal for injecting the grout.

In another embodiment of the invention, the channel consists of a tube welded to the inside of the wall of the pile and communicating with any check-valve that the grout is injected through.

In one particular embodiment of the invention the feed channel is broken up into sections essentially as long as the sections of the tube that are welded together to constitute the pile, each section of the channel being provided at each end with a funnel-shaped piece to provide continuous guiding of the injection device with its plugs when it slides inside the channel for being positioned in front of the desired check-valve.

In one preferred embodiment of the invention each end of the various sections of the feed channel corresponding to various sections of the tube that are welded together for constituting the pile is accommodated in a sleeve having inside dimensions slightly larger that the outside dimensions of the channel in such a way that the continuity between two channel sections is never interrupted and it is impossible for any material to travel from the channel to the inside of the pile or vice versa.

This device obviously makes it possible in accordance with the invention to simply and economically inject grout separately as needed through any one of the different check-valves prepositioned in the wall of the tube that constitutes the pile or on the feed channel in direction of the interior of the pile.

Another object of the invention is a process for increasing the resistance of a tubular pile driven in the soil by injection of grout in the outside vicinity of the pile wall comprising the prepositioning of check-valves on a generatrix of the pile wall, the prepositioning of a feed channel on the inside of the pile wall along said generatrix, said feed channel communicating with said check-valves, the introduction in the feed channel of an injection device comprising an injection line with at least one plug allowing the communication of pressure inside the injection line to one of the check-valves and injecting grout coming from the injection line through said check-valves toward the outside of the pile wall.

Another object of the invention is a process similar to the above mentioned process for injecting grout in the ground inside a pile driven in the ground in which process the check-valves can be located in the pile wall with their discharge openings directed toward the inside of the pile or can be directly connected to the feed channel for discharging the grout inside the pile.

In this case the resistance of the pile is increased by the consolidation of the soil confined inside the pile, said soil forming a solid unit with the pile itself.

If the injection line comprises two plugs, one is located above and the other is located under the check-valve to be injected and the end of the tube constituting the injection line which is located between the two plugs will force the grout to flow through the check-valve.

If the injection line comprises only one plug located above the end of the tube constituting the injection line, the plug is positioned above the check-valve receiving the injection which takes place after the setting of the grout previously injected in the feed channel under the level of said check-valve.

The plugs to be used can by air or water inflatable plugs of any known type.

One other object of the present invention is a short check-valve usable in the above mentioned device according to the invention that will allow repeated injection of grout to the outside of the pile while preventing solids or liquids surrounding the pile from flowing in, comprising a highly resilient tubular flap secured at one end to the frame of the check-valve, and resting against a cylindrical seat at the center, the seat being supplied with bores that communicate with the inside of the pile, said tubular flap being surrounded by a readily compressible resilient ring that deforms by changing in thickness when grout is forced by injection through the bores, with the grout that circulates toward the outside of the pile flowing between the seat and the inside of the tubular flap and with the resilient ring that surrounds the tubular flap helping to force it back against the seat when the injection ceases and then returning to its original shape in such a way that no grout remains in the check-valve. check-valve with for example an adhesive or by means of mechanical constriction.

The bores that connect the inside of the pile with the interior surface of the tubular flap preferably open in the vicinity of the end of the tubular flap that is secured to the body of the check-valve in such a way that, when the tubular flap is closed, as much of its surface as possible will be in contact with the central cylindrical seat.

The position and cross-section of the bores allow them to be thoroughly rinsed with water subsequent to injection to prevent the formation of plugs of hardened grout.

In one embodiment of the invention the inside center of the check-valve has a cavity, preferably conical, that the bores open into at an acute angle to the axis of the check-valve.

In one preferred embodiment of the invention the resilient tubular flap is made out of a material with a Shore hardness of approximately 60 to 80. It will accordingly open only when the injection pressure exceeds a prescribed level.

It is practical for the more resilient ring that surrounds the resilient tubular flap to be made out of foam rubber with a Shore hardness of 40 to 50.

The device that has just been described makes it possible to build a check-valve that allows the cement grout to travel from the inside to the outside of the pile several times while preventing travel in the opposite direction and that is only a few centimeters thick, corresponding considerably to the thickness of the wall of the steel tube that constitutes the pile.

The check-valve can be screwed to great advantage into a threaded bore in the wall of the pile with a tight packing, such as an air-tight toroidal gasket interposed.

A number of check-valves like those just described can be positioned in the wall of the tube that constitutes the pile and along at least one generatrix before the pile is driven in Grout can then be injected at the requisite points and as often as necessary.

Placement of these check-valves before the piles are driven in entails only minor additional expense and allows considerable savings when the cement grout is later injected.

Figure 2:
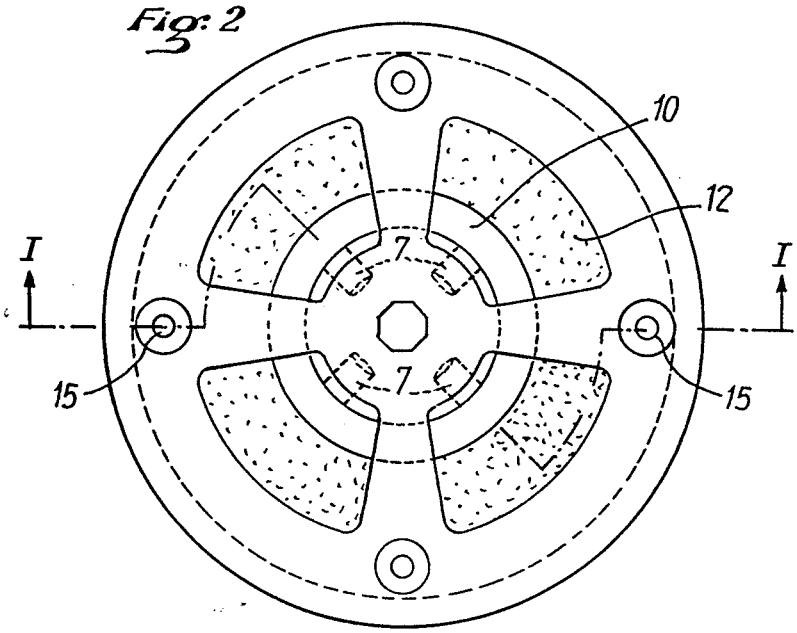
Figure 3:
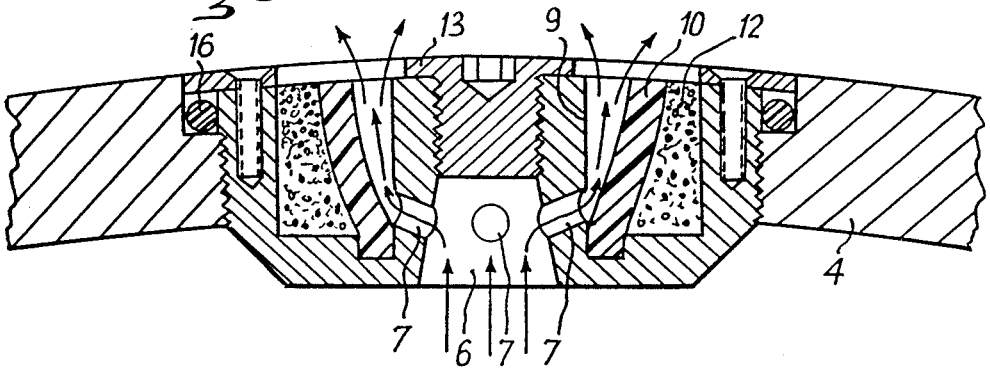
Figure 4:
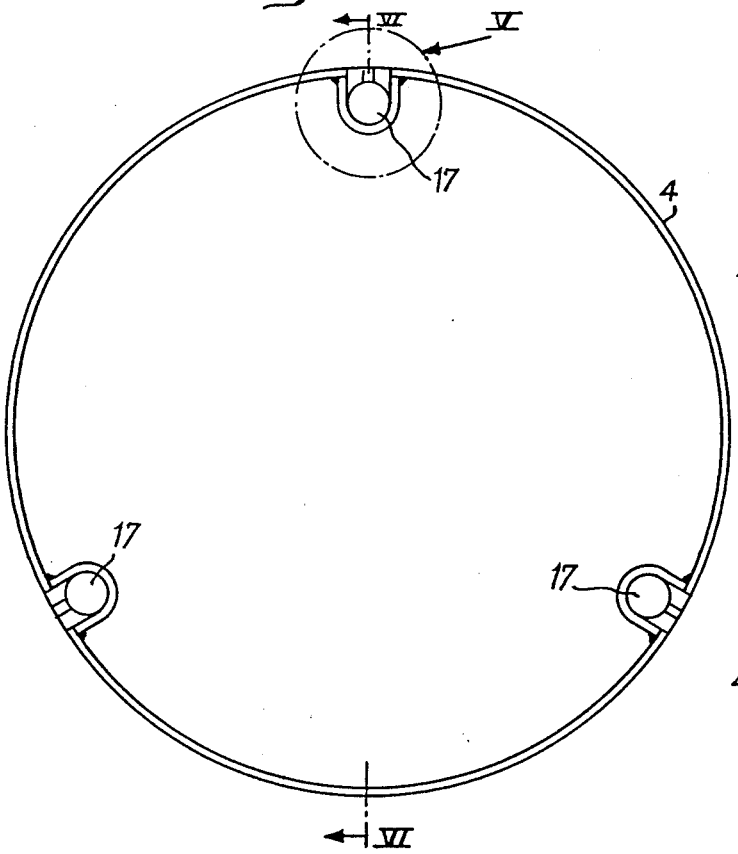
Figure 9:
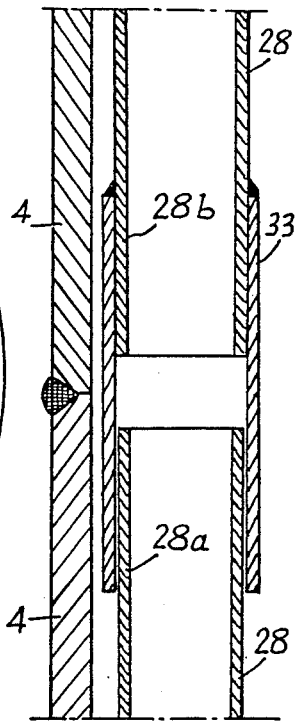
Figure 5:
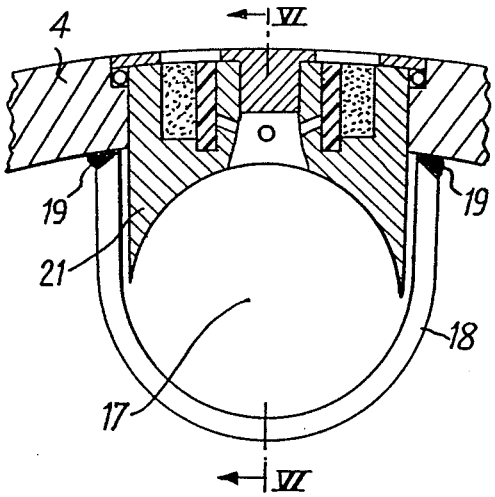
Figure 7:
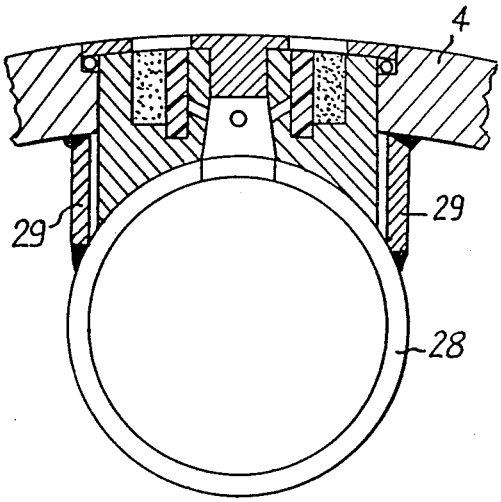
Figure 8:
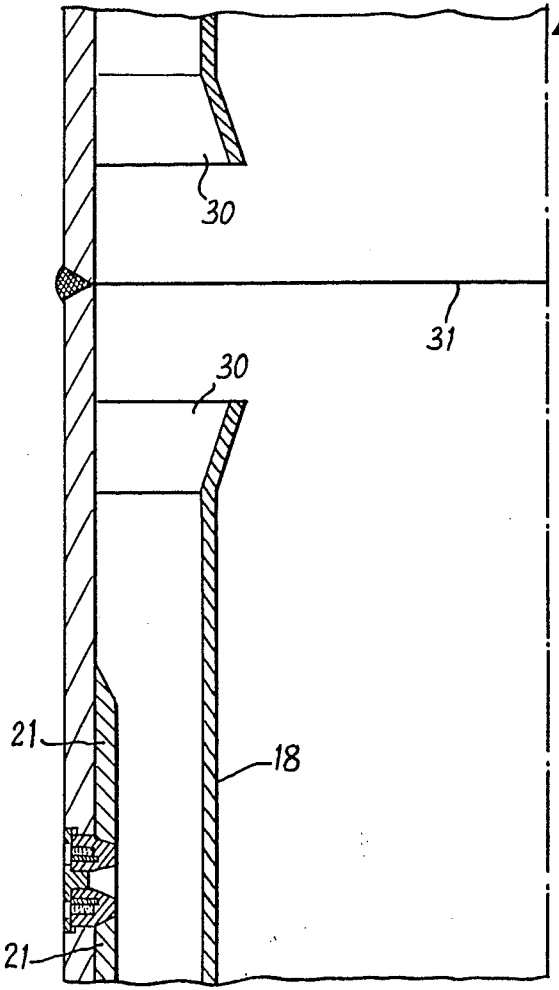
Figure 6:
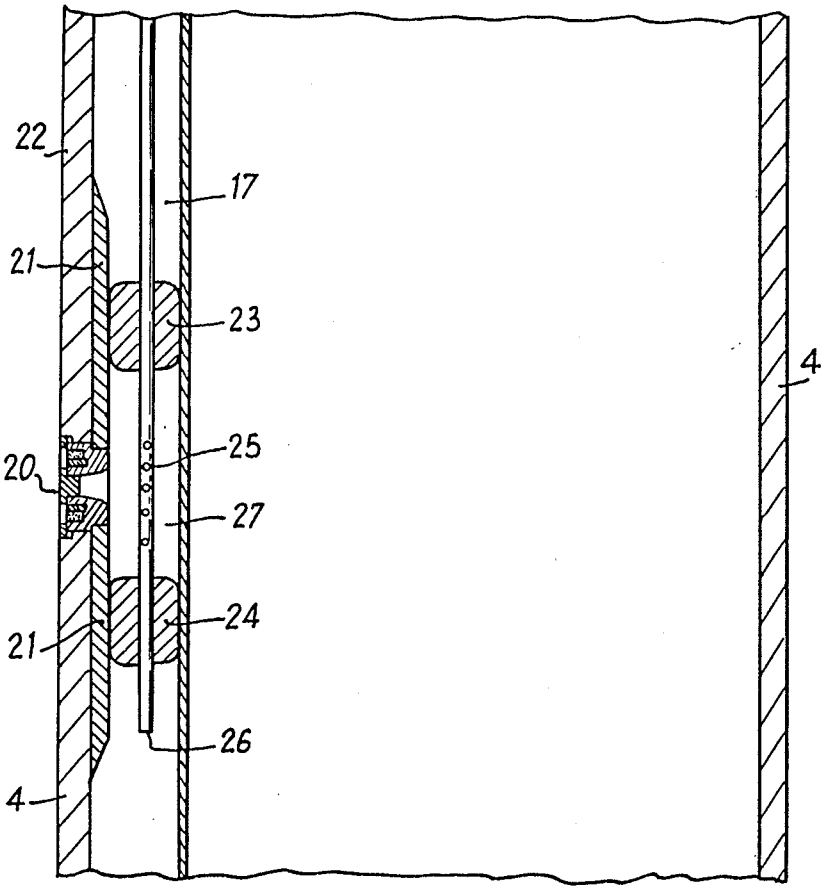
Figure 10:
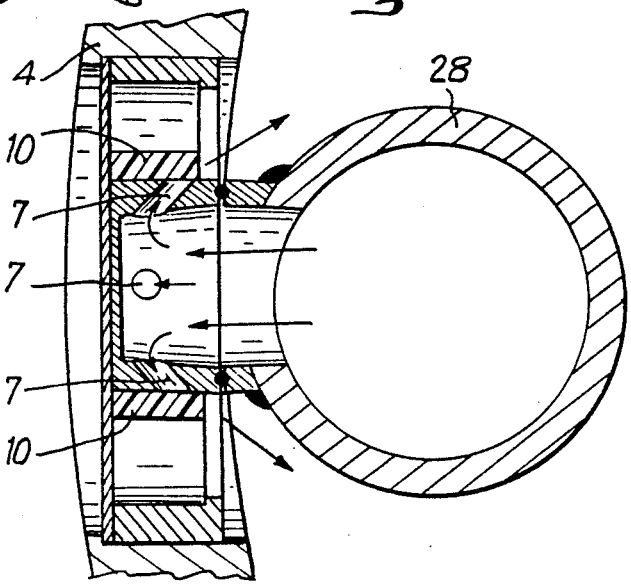

Some preferred embodiments of the invention will now be described by way of example and without limiting the scope of the invention in any way with reference to the attached drawings, wherein FIG. 1 is a section along line I—I in FIG. 2 through one embodiment of a check-valve in accordance with the invention, FIG. 2 is a top view of the check-valve illustrated in FIG. 1, FIG. 3 is a section similar to that of FIG. 1 and illustrating the same check-valve while grout is being injected, FIG. 4 is a section through a pile with three ranks of check-valves of the type illustrated in FIG. 1 that can be fed with grout through a device in accordance with the invention, FIG. 5 is a larger-scale detail of the area V in FIG. 4, FIG. 6 is a section along the line VI—VI in FIGS. 4 and 5, FIG. 7 illustrates a variant of the device that conveys the grout injector along the inside of the wall of the pile, FIG. 8 is a longitudinal section through the device illustrated in FIGS. 4 and 5 showing the welded joint between two sections of steel tube constituting a pile, FIG. 9 illustrates a variant of the device in FIG. 8, FIG. 10 is a cross section of a variant of the valves of FIGS. 5 and 7 for injecting grout inside the pile.

Figure 11:
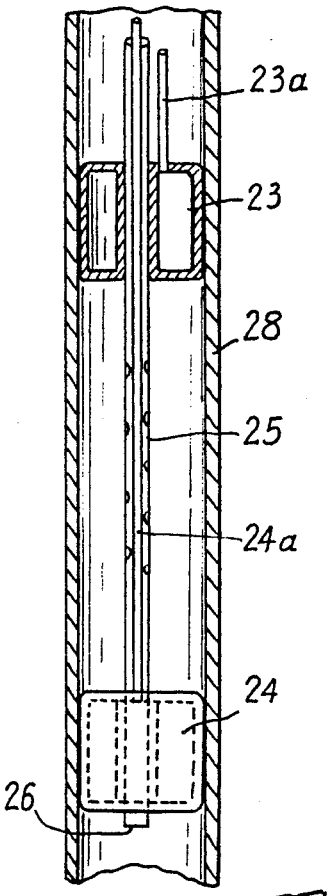
Figure 12:
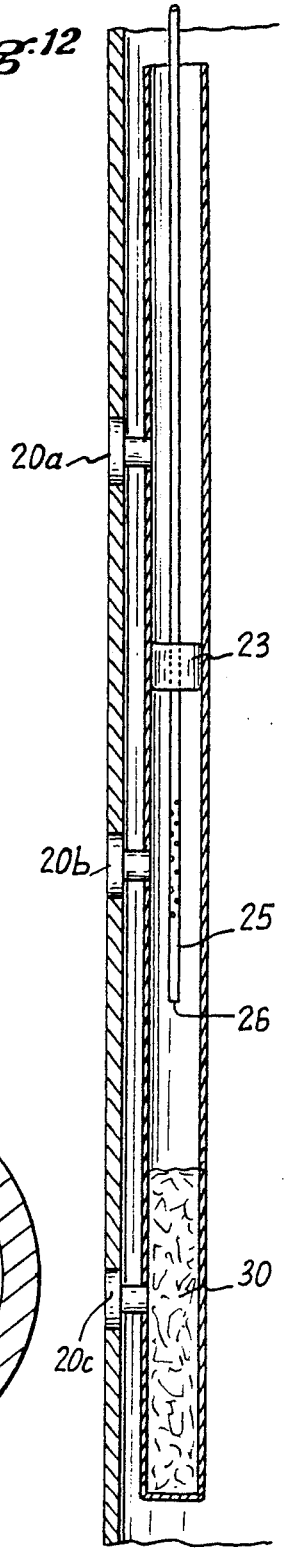

FIG. 11 is a cross section of the injection line showing how the inflatable plugs can be actuated, and FIG. 12 is a cross section of the bottom part of the grout feed channel showing the use of an injection line with only one inflatable plug.

In FIG. 1, the body 1 of the check-valve has a cylindrical external surface 2 provided with threading so that it can be screwed into a matching threaded bore 3 in the wall 4 of the steel tube that constitutes the pile.

The inside center 5 of the body 1 of the check-valve has a preferably conical cavity 6 provided in the illustrated embodiment with four sloping bores 7 that empty into an annular cavity 8 inside body 1 and that the grout travels through.

Annular cavity 8 is demarcated inside by a cylindrical seat 9, which sloping bores 7 empty through.

A highly resilient tubular flap 10 is secured at the bottom (as viewed in FIG. 1) into an annular cavity 11 in the base of body 1. In the embodiment now being described, tubular flap 10 is secured with an adhesive in annular cavity 11 in such a way that the end in question is rigidly fastened.

At rest, tubular flap 10 preferably rests resiliently against cylindrical seat 9.

The remainder of annular cavity 8 is filled with an easier to deform resilient foam-rubber ring 12 that constantly forces tubular flap 10 against cylindrical seat 9 and fills up annular cavity 8 upon termination of injection to prevent grout from remaining there and hardening, thus constricting tubular flap 10 and preventing any further injection.

A cover 13, which will be evident in elevation in FIG. 2, has a central shaft that screws into threads 14 in a matching bore in the body 1 of the check-valve.

The outer surface of cover 13 is secured in body 1 by means of screws 15.

A toroidal gasket 16 positioned around the body 1 of the check-valve 20 in a depression in the wall of the tube that constitutes the pile ensures tightness in relation to any excess pressures that may exist inside the pile.

FIG. 3 illustrates how grout injected into cavity 6 under pressure circulates through sloping bores 7 in the direction indicated by the arrows, forcing out the section of tubular flap 10 that is not secured in annular cavity 11 and compressing resilient ring 12.

Upon termination of injection, tubular flap 10 returns to its initial shape against the cylindrical seat 9 in the body 1 of the check-valve, assisted by the resiliency of ring 12, which completely fills up annular cavity 8, preventing any material outside the pole from penetrating inside and expelling any grout that might tend to remain in cavity 8. It is now only necessary to rinse out cavity 6 and sloping bores 7 by injection water instead of grout.

This keeps the check-valve almost completely free of grout and allows successive injections of grout even at intervals long enough for it to have hardened.

The check-valve in accordance with the invention is also comparatively short and will not project outside the wall of the pile to any considerable extent.

This shortness is essentially due to the bottom (as viewed in FIGS. 1 and 3) of tubular flap 10 being secured in accordance with the invention to the body 1 of the check-valve, with grout-injection sloping bores 7 also located at the bottom. FIG. 4 is a horizontal section through a pile with three grout-injection devices in accordance with the invention. One can see on FIG. 4 the circular wall 4 on which three check-valves are mounted.

As shown on FIGS. 4, 5 and 6, a feed channel 17 with a relatively small diameter made with a U-shaped section 18 of steel having its longitudinal edges welded at points 19 to the inside surface of wall 4.

Shaped pieces 21 are fastened to the inside of wall 4, making the cross-section of the resulting feed channel 17 essentially round in the vicinity of each check-valve 20.

It accordingly become possible to slide through feed channel 17 an injection line for injecting either grout or water and consisting of a line 22 that extends through two sealing plugs 23 and 24, which can for instance be water or air inflated and which are separated to a certain extent, that has apertures 25 in it between the two plugs, and that is closed off at its lower end 26.

By appropriately positioning plugs 23 and 24 on each side of a check-valve it is possible to inject grout at a prescribed pressure into the space 27 between said plugs forcing the grout out through the check-valve and between the pile and the ground that surrounds it.

Upon termination of injection it is also possible to similarly inject water at a pressure lower than that of the grout by loosening one of the plugs to allow water to flow past it. This rinses out conical cavity 6 and clears bores 7 of any grout that may remain in them without opening tubular flap 10 or allowing rinse water to leave the pile. The penetration of the rinse water into cavity 6 and bores 7 is facilitated by the conical shape of the cavity and by the acute angle of the bores to axis of the check-valve.

In the variant illustrated in FIG. 7, feed channel 17 consists of a round tube 28 welded directly to the inside of wall 4 by means of enough cheek plates 29 to ensure stability.

In this embodiment, feed channel 17 is in the form of a tube extending from the top to the bottom, the check-valve being connected with the inside of said feed channel.

In one variant, feed channel 17 extends not through the axes of the check-valves but alongside them, decreasing the amount of space taken up by the device in accordance with the invention inside the pile.

FIG. 8 illustrates how the continuity of feed channel 17 is maintained at the joints between two sections of pile. The lengths of section 18 that constitute the channel (which may be U-shaped or round) terminate at a certain distance from the ends 31 of the sections of pile in funnel shapes 30 that facilitate sliding injection line 22, 23 and 24 through feed channel 17.

In the variant illustrated in FIG. 9, the continuity of feed channel 17 is ensured by a sleeve 33 welded to the lower end **28*b* and accomodating the upper end 28*a*** of the adjacent section just below the joint between the two sections of pile.

FIG. 10 represents a check-valve for injecting grout inside the pile. In this embodiment the bores 7 are directed toward the inside of the pile for discharging the grout arround the connexion between the check-valve and the feed channel which is attached to the pile wall by way of brackets located between the check-valves.

Rinse water can also be injected through the embodiment of FIG. 10.

FIG. 11 is an enlarged view of FIG. 6 where one can see the cross section of plug 23 which presents an hollow toroidal form connected by a small diameter pipe **23*a* to a device located on the platform and able to inject a fluid under pressure inside the plug 23** to close tightly the feed channel above the openings of the injection line or to release said pressure when moving the injection line from one check-valve to another.

If the injection line has only one plug, it is an advantage to position it above the check-valve and to start the injection with the lowest valve and moving toward the top from valve to valve.

This process is shown on FIG. 12. On that figure grout 30 has been already injected through the check-valve **20*c* after which the injection line has been positionned as represented on FIG. 12 for proceeding to the injection through check-valve 20*b***.

One understand that by injecting through one check-valve and moving the injection line up to the next check-valve successively, it is possible to inject grout through any check-valve located on the corresponding feed channel.

Anyhow in this case a second injection cannot be performed because the feed channel remains full of solid grout.

It will be obvious that the invention allows one or more check-valves to be positioned along one or more generatrices of the tubular pile and grout to be injected through the desired check-valve or check-valves in such a way as to penetrate into the surrounding ground without allowing either grout or ambient water into the pile itself.

What is claimed is:

1. A device for injecting ground around a tubular pile driven into the ground, wherein said tubular pile has a given diameter and is formed by a tubular wall of a given wall thickness defining the inside and outside of said tubular pile, comprising:

a grout feed channel capable of being driven into the ground with said tubular pile disposed inside said tubular wall having a diameter which is small relative to the diameter of said tubular pile;

a check valve connected to said grout feed channel at a position along said tubular wall and extending through the thickness of said tubular wall so as to communicate from said grout feed channel through the outside of said tubular wall; and an injection device inserted in said grout feed channel having one plug which is fitted in said grout feed channel and located above said check valve so as to inject grout under pressure through said injection device and said check valve to the outside of said tubular wall.

2. A device according to claim 1 in which a plurality of check-valves are located along a generatrix in the wall of the pile for discharging the grout outside of the tubular pile.

3. A device for injecting grout inside a tubular pile driven into the ground wherein said tubular pile has a given diameter and is formed by a tubular wall of given wall thickness defining the inside and outside of said tubular pile comprising:

a grout feed channel capable of being driven into the ground with said tubular pile disposed inside the tubular wall having a diameter which is small relative to the diameter of said tubular pile;

a check valve connected to said grout feed channel at a position along said tubular wall as to communicate from said grout feed channel through to the inside of said tubular wall; and an injection device inserted in said grout feed channel having one plug fitted in said grout feed channel above the position of said check-valves so as to inject grout under pressure through said injection device and said check-valves to the inside of said tubular wall.

4. Device according to claim 3, in which a plurality of check-valves is located along a generatrix in the wall of the pile for discharging the grout inside the tubular pile.

5. Device according to claims 1 or 3 in which the injection device comprises two plugs fitted in said grout feed channel positionned spaced apart the position of one check-valve.

6. Device according to claims 1 or 3 in which the grout feed channel is a U-shaped section of steel affixed along a generatrix of the inside surface of the tubular pile.

7. Device according to claim 6 in which shaped pieces are located inside said grout feed channel in the vicinity of each check-valve to provide said channel with a circular cross-section that allows the plugs of the injection device to form a tight seal for injecting the grout.

8. Device according to claims 1 or 3, in which the feed channel consists of a tube welded to the inside surface of the tubular pile.

9. Device according to claims 1 or 3 in which the grout feed channel is broken up into sections specially as long as the sections of the tubular pile that are welded together for constituting the pile, each section of the grout feed channel being provided at each end with a funnel-shaped piece to provide continuous guiding of the injection device with its plugs when it slides inside the grout feed channel for being positioned in front of any check-valve.

10. Device according to claims 1 or 3 in which the grout feed channel is broken up into sections essentially as long as various sections of the tubular pile that are welded together for constituting the pile, the two ends of two adjacent sections of the grout feed channel being connected with an outer sleeve.

11. Device according to claims 1 or 3 in which the plugs of the injection device are water or air inflatable.

12. Process for increasing the resistance of a tubular pile driven in the soil by injection of grout in the outside vicinity of the pile wall comprising the prepositioning of check-valves on a generatrix of the pile wall, the prepositioning of a feed channel on the inside of the pile wall along said generatrix, said feed channel communicating with said check-valves, driving said tubular pile with said feed channel into the ground, the introduction in the feed channel of an injection device comprising an injection line with one plug situated above the check-valve receiving the injection and allowing the communication of the pressure existing inside the injection line to one of the check-valves and injecting grout arriving from the injection line through said check-valves toward the outside of the pile wall.

13. Process for increasing the resistance of a tubular pile driven to a soil by injection of grout in the inside of the pile wall comprising the prepositioning of a feed channel on the inside of the pile wall along one generatrix, said feed channel communicating with at least one check-valve above to discharge the grout in the inside of the pile wall, driving said tubular pile with said feed channel into the ground, the introduction in the feed channel of an injection device comprising an injection line with one plug situated above the check-valve receiving the injection and allowing the communication of the pressure existing inside the injection line to one of the check-valves and injecting grout arriving from the injection line through said check-valves toward the inside of the pile wall.

14. Process according to claims 13 in which the injection line comprises two plugs fitted in said grout feed chanel positionned spaced apart the position of one check-valve.

15. A check-valve usable according to claims 1 or 3 for allowing the repeated injection of a material through said check-valve while preventing material from traveling in the opposite direction, comprising:

a cylindrical seat having a body portion with a central passage defined therein and a plurality of bores communicating from the central passage on the inside of the seat to an outside surface of the seat, said central passage of said body portion being adapted to receive a flow of material injected in the hollow member;

a resilient tubular flap fitted over the outside surface of said cylindrical seat having one end portion fixed to the body portion of said cylindrical seat, an intermediate portion covering said bores, and a free end portion, said intermediate and free end portions being adapted to be expanded apart from the outside surface of said cylindrical seat by the pressure of the injected material forced through said central passage and said bores of said cylindrical seat; and an outer frame mounting said cylindrical seat fixedly therein and having an outer wall defining a space around at least a part of said tubular flap, said space being occupied by a compressible material more resilient than said tubular flap, said compressible material permitting said tubular flap to expand outward upon injection, preventing injected material from entering the space around the tubular flap, and helping to force said tubular flap closed against said cylindrical seat upon termination of injection.

16. A check-valve according to claim 15 adapted for repeated injection of a hardening material such as grout from the inside of a tubular pile to the outside thereof, said tubular pile having an opening therethrough, and said outer frame of said check-valve for mounting said check-valve axially in said opening.

17. A check-valve according to claim 16, wherein said outer wall of said outer frame is an annular wall, said space is an annular space, said compressible material is formed as a resilient ring completely filling said annular space, said plurality of bores are spaced apart circumferentially around said cylindrical seat, and said tubular flap has a short length in relation to its diameter such that said check-valve has an axial length short enough to be positioned substantially flush in said opening in said tubular pile.

* * * * *

UNITED STATES PATENT AND TRADEMARK OFFICE

CERTIFICATE OF CORRECTION

PATENT NO. : 4,948,301

DATED : August 14, 1990

INVENTOR(S) : Jean-Paul Geffriaud et al.

It is certified that error appears in the above-identified patent and that said Letters Patent is hereby corrected as shown below:

Col. 7, Line 1, Claim 1

"ground" should read --grout--

Signed and Sealed this

Twenty-first Day of January, 1992

*Attest:*

HARRY F. MANBECK, JR.

*Attesting Officer*

*Commissioner of Patents and Trademarks*